United States Patent [19]

Gross

[11] 4,033,284

[45] July 5, 1977

[54] APPARATUS FOR APPLYING ADHESIVE TO A FURNITURE COMPONENT

[75] Inventor: William G. Gross, York, Pa.

[73] Assignee: Armstrong Cork Company, Lancaster, Pa.

[22] Filed: June 2, 1976

[21] Appl. No.: 692,107

[52] U.S. Cl. ..... 118/3; 118/241

[51] Int. Cl.[2] ..... B05C 11/00

[58] Field of Search ..... 118/3, 241, 412; 38/43

[56] References Cited

UNITED STATES PATENTS

| | | | |
|---|---|---|---|
| 380,965 | 4/1888 | Whitaker et al. | 38/43 |
| 2,806,443 | 9/1957 | Horn et al. | 118/3 |
| 3,064,620 | 11/1962 | Bornemann | 118/3 |
| 3,379,167 | 4/1968 | Douglas | 118/3 |
| 3,597,866 | 8/1971 | Bettarini et al. | 38/43 X |

FOREIGN PATENTS OR APPLICATIONS

| | | | |
|---|---|---|---|
| 453,275 | 11/1949 | Italy | 118/3 |

*Primary Examiner*—Robert R. Mackey

[57] ABSTRACT

An apparatus for applying an adhesive to a furniture component wherein the furniture component has a plurality of points to receive the adhesive. The adhesive-applying apparatus has a plurality of adhesive-dispensing nozzles arranged in a pattern similar to the pattern of points on the furniture component to receive the adhesive. Means are provided to move the adhesive-dispensing nozzles into registration with the furniture component so that the nozzles match up with the points to receive the adhesive and dispense the adhesive to these points.

1 Claim, 1 Drawing Figure

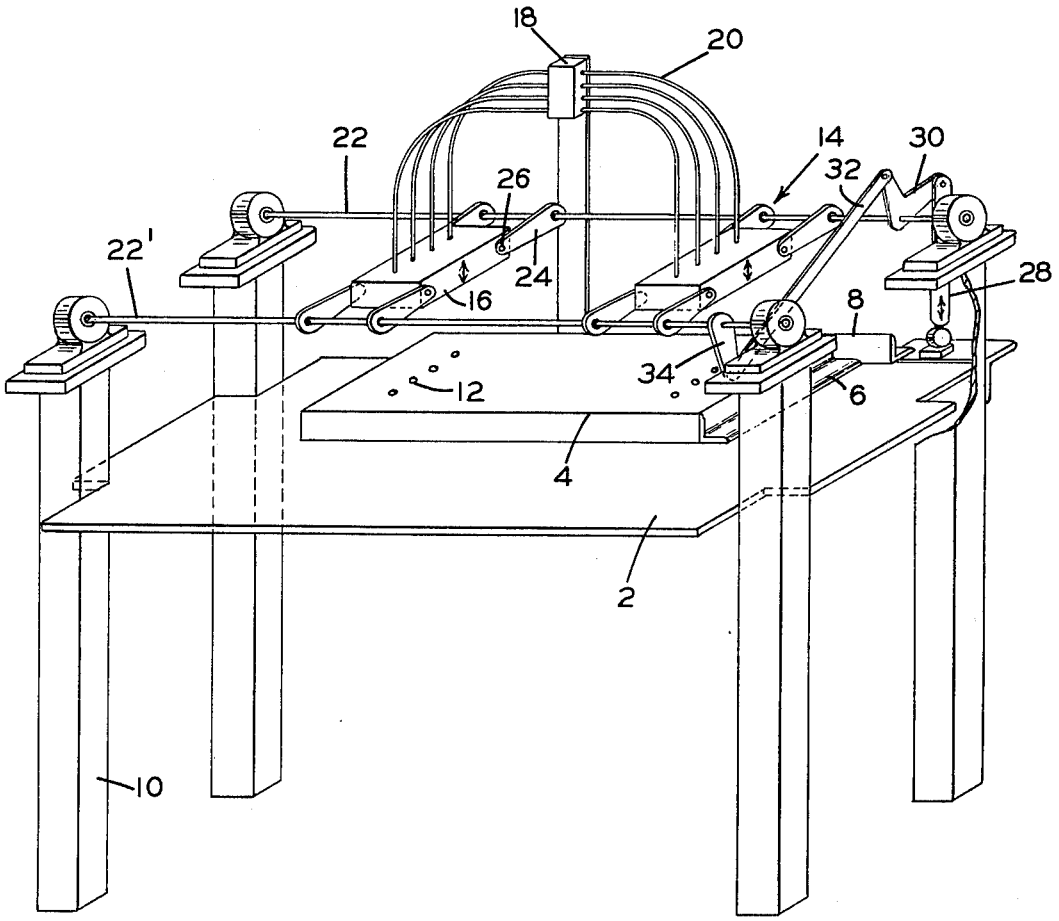
18
20
22
14
30
26
32
22'
24
28
16
8
34
12
6
4
2
10

APPARATUS FOR APPLYING ADHESIVE TO A FURNITURE COMPONENT

BACKGROUND OF THE INVENTION 1. Field of the Invention

The invention is directed to a gluing apparatus and, more particularly, to a gluing apparatus for automatically dispensing an adhesive to a large number of points simultaneously.

2. Description of the Priod Art

U.S. Pat. No. 3,064,620 is directed to an apparatus that dispenses a liquid from a plurality of nozzles in a one-step dispensing operation.

U.S. Pat. 2,101,464 is directed to an adhesive-applying device for applying an adhesive at predetermined points.

SUMMARY OF THE INVENTION

The invention is directed to an apparatus for applying an adhesive to a furniture component containing a number of apertures designed to receive the application of adhesive thereto. The furniture component is positioned on a table and held in a certain position by a plurality of guide structures. An adhesive-applying structure is composed of a mounting structure carrying several adhesive-applying nozzles. The mounting structure for the adhesive-applying nozzles is positioned above the apertures to receive the adhesive. Means moves the nozzle mounting structure toward and away from the furniture component. When the nozzle-mounting structure is in position relative to the furniture component, the nozzles dispense the adhesive into the apertures of the furniture component. The nozzle-mounting structure is moved away from the furniture component to permit the removal of that particular furniture component and the placement of another furniture component in position to receive adhesive.

BRIEF DESCRIPTION OF THE DRAWING

The drawing is a perspective representation of the inventive apparatus herein.

DESCRIPTION OF THE PREFERRED EMBODIMENT

The invention is directed to an apparatus for applying adhesive to a furniture component containing a number of apertures designed to receive an application of adhesive thereto. The apparatus somewhat automates the applying of the adhesive in that, simultaneously, a number of points of adhesive are applied and the application of the adhesive is controlled in register with the area which are to receive the adhesive.

The apparartus is composed of, basically, a support means for the furniture component, an adhesive-applying means, and a means for moving the adhesive-applying means. The support means has a flat surface 2 on which the furniture component 4 will be placed. Guide means 6 and 8 are provided to help position the furniture component 4 in a predetermined position on the surface 2. The surface 2 is supported by four legs 10. The flat surface 2 may be adjustable relative to the top of the four legs 10. The top of the four legs 10 function as support means for the means which moves the adhesive-applying means relative to the furniture component to be described below.

The furniture component may have a series of points or apertures 12 which are to receive the adhesive. Normally in the art, adhesive would be individually applied to these series of points through the use of a hand or air-operated adhesive dispenser. The improvement in the prior art exists in the below-described structure.

An adhesive-applying means (assembly) 14 is positioned above the furniture component meant to receive the adhesive. The adhesive-applying assembly has a plurality of nozzles similar to those shown in U.S. Pat. No. 3,064,620. The end of the nozzle extends slightly below the mounting structures 16. The mounting structures hold the adhesive nozzles in a prearranged pattern so that there is a nozzle positioned above each point where adhesive is to be applied to the furniture component. Each nozzle has a plunger which has an end extending slightly beyond the mounting structure. When the mounting structure is lowered relative to the furniture component, the plunger engages the furniture component and opens a valve within the nozzle. Adhesive may then be dispensed from the nozzle to the furniture component. Adhesive is provided from a central supply 18 through hoses 20 to each nozzle. By cycling the nozzle-mounting structures into and out of engagement towards and away from the furniture components so that the nozzle plunger will engage and disengage from the furniture component, it is possible to deposit a quantity of adhesive on the furniture component. The period of time that the plunger of the nozzle is in engagement with the furniture component will determine the amount of adhesive dispensed. As indicated above, the primary purpose of the mounting structure is to position the adhesive nozzles in an array relative to the points on the furniture component to receive the adhesive. Consequently, each time that a furniture component is put into position and located on the table 2 by guides 6 and 8, the furniture component will have its adhesive-receiving points in register with the array of adhesive nozzles, and one may rapidly apply adhesive to a number of points on the furniture component at one time.

Means must be provided for moving the adhesive nozzles into and out of engagement with the furniture component. These means are now described below. This means comprises a mechanical linkage which is supported on the tops of the legs 10. On the tops of the legs there sre mounted bearing blocks which support two rods 22 on either side of the mounting structures for the adhesive nozzles. The rods 22 are connected to the structures 16 by lever arms 24. The lever arms 24 are fixedly positioned on the rods 22 so that they swing in an arc as the rods oscillate. The rods oscillate in opposite directions and cause the ends 26 of the levers 24 to move in a generally upward and downward path. The ends 26 of the levers 24 are fastened to the mounting structure 16. A bolt passes through the lever arms 24 and the mounting structure 16. The hole in the mounting structure through which the bolt passes is slightly oversize to allow for freedom of movement of the mounting structure 16 upward and downward as the rods 22 oscillate.

An air cylinder 28 is fastened to a crank lever 30 which is fixedly positioned on one of the rods 22. Movement of the air cylinder causes crank arm 30 to oscillate and, consequently, one rod 22 oscillate A lever 32 connects to a lever 34 which is mounted on the second rod 22'. Lever 32 is connected to crank 30. Therefore, movement of crank 30 also causes movement of lever 34. Consequently, movement of rod 22 in a counterclockwise direction will cause movement of rod 22′ in a clockwise direction. Movement of the two rods, as indicated above, through the use of levers 24, then causes the adhesive-applying nozzle mounting structure 16 to move upward away from the furniture component and downward towards the furniture component so that at that time adhesive may be deposited on selected areas of the furniture component 4. Naturally, air cylinder 28 can be actuated by the operator by any conventional control means utilized for operating air cylinders.

I claim

1. An apparatus for applying adhesive to a furniture component containing a number of apertures designed to receive an application of adhesive and then subsequently assembled to other furniture components, comprising:

a. a surface upon which said furniture component is positioned, a plurality of guide structures to fixedly position said furniture component in a specific position upon said surface, b. an adhesive-applying structure composed of a mounting structure and several adhesive-applying nozzles, said mounting structure being a mounting block within which the adhesive-applying nozzles are positioned, said mounting block being positioned above the furniture component and said adhesive-applying nozzles being positioned above the apertures to receive adhesive, c. means mounting said mounting block for movement towards and away from said furniture component, said mounting means moving said mounting block and nozzles into position with said nozzles within said apertures to receive adhesive, d. means dispensing adhesive from said nozzles into said apertures, said moving means then moving said mounting block and nozzles away from said furniture component after adhesive has been applied to said apertures, and e. said moving means consisting of 1. two parallel rods, 2. a plurality of levers, said levers being fixedly positioned at their one ends to the rods and on their opposite ends being fastened pivotedly to the mounting block, 3. said parallel rods being mounted for oscillating movement and being positioned one on either side of the mounting block, one said parallel rod moving in a clockwise direction while said other parallel rod moves in a counterclockwise direction, and 4. the oscillating movement of the parallel rods causes the levers fixedly positioned thereon to have an oscillating movement also, said levers being affixed to the mounting block, thereby causing the mounting block to have an oscillating movement up and down relative to the surface upon which the furniture component is positioned.

* * * * *